US011388538B2

(12) United States Patent
Tsuchida

(10) Patent No.: US 11,388,538 B2
(45) Date of Patent: Jul. 12, 2022

(54) SIGNAL PROCESSING DEVICE, SIGNAL PROCESSING METHOD, AND PROGRAM FOR STABILIZING LOCALIZATION OF A SOUND IMAGE IN A CENTER DIRECTION

(71) Applicant: Sony Corporation, Tokyo (JP)

(72) Inventor: Yuji Tsuchida, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 17/269,240

(22) PCT Filed: Aug. 15, 2019

(86) PCT No.: PCT/JP2019/032048
§ 371 (c)(1),
(2) Date: Feb. 17, 2021

(87) PCT Pub. No.: WO2020/045109
PCT Pub. Date: Mar. 5, 2020

(65) Prior Publication Data

US 2021/0329396 A1 Oct. 21, 2021

(30) Foreign Application Priority Data

Aug. 29, 2018 (JP) ..... JP2018-160185

(51) Int. Cl.
*H04S 7/00* (2006.01)
*H04R 3/04* (2006.01)
(Continued)

(52) U.S. Cl.
CPC ..... *H04S 7/302* (2013.01); *H04R 3/04* (2013.01); *H04R 5/033* (2013.01); *H04R 5/04* (2013.01); *H04S 2420/01* (2013.01)

(58) Field of Classification Search
None
See application file for complete search history.

(56) References Cited

U.S. PATENT DOCUMENTS 5,696,831 A * 12/1997 Inanaga ..... H04S 1/007 381/309
2014/0270185 A1 9/2014 Walsh
(Continued)

FOREIGN PATENT DOCUMENTS

CN 104240695 A 12/2014
JP H05-168097 A 7/1993
(Continued)

OTHER PUBLICATIONS

Lv Fei et al., "Study on Computational Model of Auditory Selective Attention with Orientation Feature", Acta Automatica Sinica, Apr. 2017, vol. 43, No. 4.
(Continued)

*Primary Examiner* — James K Mooney
(74) *Attorney, Agent, or Firm* — Wolf, Greenfield & Sacks, P.C.

(57) ABSTRACT

The present technology relates to a signal processing device, a signal processing method, and a program capable of stabilizing localization of a sound image in a center direction.
Input signals of audio of two channels are added to generate the addition signal. Moreover, convolution of the addition signal and a head related impulse response (HRIR) in a center direction is performed to generate a center convolution signal. Furthermore, convolution of the input signal and a binaural room impulse response (BRIR) is performed to generate an input convolution signal. Then, the center convolution signal and the input convolution signal are added to generate an output signal. The present technology can be applied, for example, in a case of reproducing listening conditions in various sound fields.

6 Claims, 13 Drawing Sheets

(51) Int. Cl.
*H04R 5/033* (2006.01)
*H04R 5/04* (2006.01)

(56) References Cited

U.S. PATENT DOCUMENTS

| | | | |
|---|---|---|---|
| 2015/0156599 | A1 | 6/2015 | Romigh |
| 2017/0026771 | A1 | 1/2017 | Shuang |
| 2018/0233156 | A1 | 8/2018 | Breebaart et al. |
| 2018/0242094 | A1 | 8/2018 | Baek |

FOREIGN PATENT DOCUMENTS

| | | | |
|---|---|---|---|
| JP | 2012-169781 | A | 9/2012 |
| WO | WO 2017/035163 | A1 | 3/2017 |
| WO | WO 2018/150766 | A1 | 8/2018 |

OTHER PUBLICATIONS

Gavin Kearney et al., Approximation of Binaural Room Impulse Responses, Department of Electronic and Electrical Engineering Trinity College Dublin, Ireland, ISSC 2009, Dublin, Jun. 10-11.
Xie Bosun, "Head-related transfer function and virtual auditory display", Science in China (G: Physics, Mechanics Astronomy), No. 9, Sep. 15, 2009.

* cited by examiner

SIGNAL PROCESSING DEVICE, SIGNAL PROCESSING METHOD, AND PROGRAM FOR STABILIZING LOCALIZATION OF A SOUND IMAGE IN A CENTER DIRECTION

CROSS-REFERENCE TO RELATED APPLICATIONS

This application claims the benefit under 35 U.S.C. § 371 as a U.S. National Stage Entry of International Application No. PCT/JP2019/032048, filed in the Japanese Patent Office as a Receiving Office on Aug. 15, 2019, which claims priority to Japanese Patent Application Number JP2018-160185, filed in the Japanese Patent Office on Aug. 29, 2018, each of which is hereby incorporated by reference in its entirety.

TECHNICAL FIELD

The present technology relates to a signal processing device, a signal processing method, and a program, and more particularly to, for example, a signal processing device, a signal processing method, and a program capable of stabilizing localization of a sound image in a center direction.

BACKGROUND ART

There is headphone virtual sound field processing as signal processing that reproduces listening conditions in various sound fields through replay by headphone that replays an audio signal using headphones.

In the headphone virtual sound field processing, convolution of an audio signal of a sound source and a binaural room impulse response (BRIR) is performed, and a convolution signal obtained by the convolution is output instead of the audio signal of the sound source. Thus, a sound source created for replay by speaker to replay the audio signal using a speaker is used to reproduce a sound field with a long reverberation time, which is difficult to replay by speaker in listening rules, and a music experience that is close to listening in an actual sound field can be provided.

Note that Patent Document 1 describes a kind of technique of headphone virtual sound field processing.

CITATION LIST

Patent Document

Patent Document 1: Japanese Patent Application Laid-Open No. 07-123498

SUMMARY OF THE INVENTION

Problems to be Solved by the Invention

In two-channel stereo replay that replays audio signals of two channels, localization of a sound image of an audio signal intended to localize the sound image toward the center (front) of a listener of (voice of) a main vocal or the like is performed by, for example, what is called phantom center localization. In the phantom center localization, the same sound is replayed (output) from the left and right speakers, and thereby the localization of the sound image in the center direction is virtually reproduced by utilizing the principle of psychoacoustics.

In a case where the sound field with a long reverberation time, which is difficult to replay by speaker in the listening room, is reproduced in the headphone virtual sound field processing, and the phantom center localization is employed as a method for localization of the sound image in the center direction, it is possible that the phantom center localization is hindered and the localization of the sound image in the center direction becomes sparse.

The present technology has been made in view of such a situation, and makes it possible to stabilize the localization of the sound image in the center direction.

Solutions to Problems

A signal processing device or program according to the present technology is a signal processing device including an addition signal generation unit that adds input signals of audio of two channels to generate an addition signal, a center convolution signal generation unit that performs convolution of the addition signal and a head related impulse response (HRIR) in a center direction to generate a center convolution signal, an input convolution signal generation unit that performs convolution of the input signal and a binaural room impulse response (BRIR) to generate an input convolution signal, and an output signal generation unit that adds the center convolution signal and the input convolution signal to generate an output signal, or a program causing a computer to perform a function as such a signal processing device.

A signal processing method according to the present technology is a signal processing method including adding input signals of audio of two channels to generate an addition signal, performing convolution of the addition signal and a head related impulse response (HRIR) in a center direction to generate a center convolution signal, performing convolution of the input signal and a binaural room impulse response (BRIR) to generate an input convolution signal, and adding the center convolution signal and the input convolution signal to generate an output signal.

In the present technology, the input signals of audio of two channels are added to generate an addition signal. Moreover, convolution of the addition signal and the head related impulse response (HRIR) in the center direction is performed to generate a center convolution signal. Furthermore, convolution of the input signals and the binaural room impulse response (BRIR) is performed to generate an input convolution signal. Then, the center convolution signal and the input convolution signal are added to generate an output signal.

Note that the signal processing device may be an independent device or an internal block constituting one device.

Furthermore, the program can be provided by transmitting via a transmission medium or by recording on a recording medium.

MODE FOR CARRYING OUT THE INVENTION

<Signal Processing Device to which Present Technology can be Applied>

Figure 1:
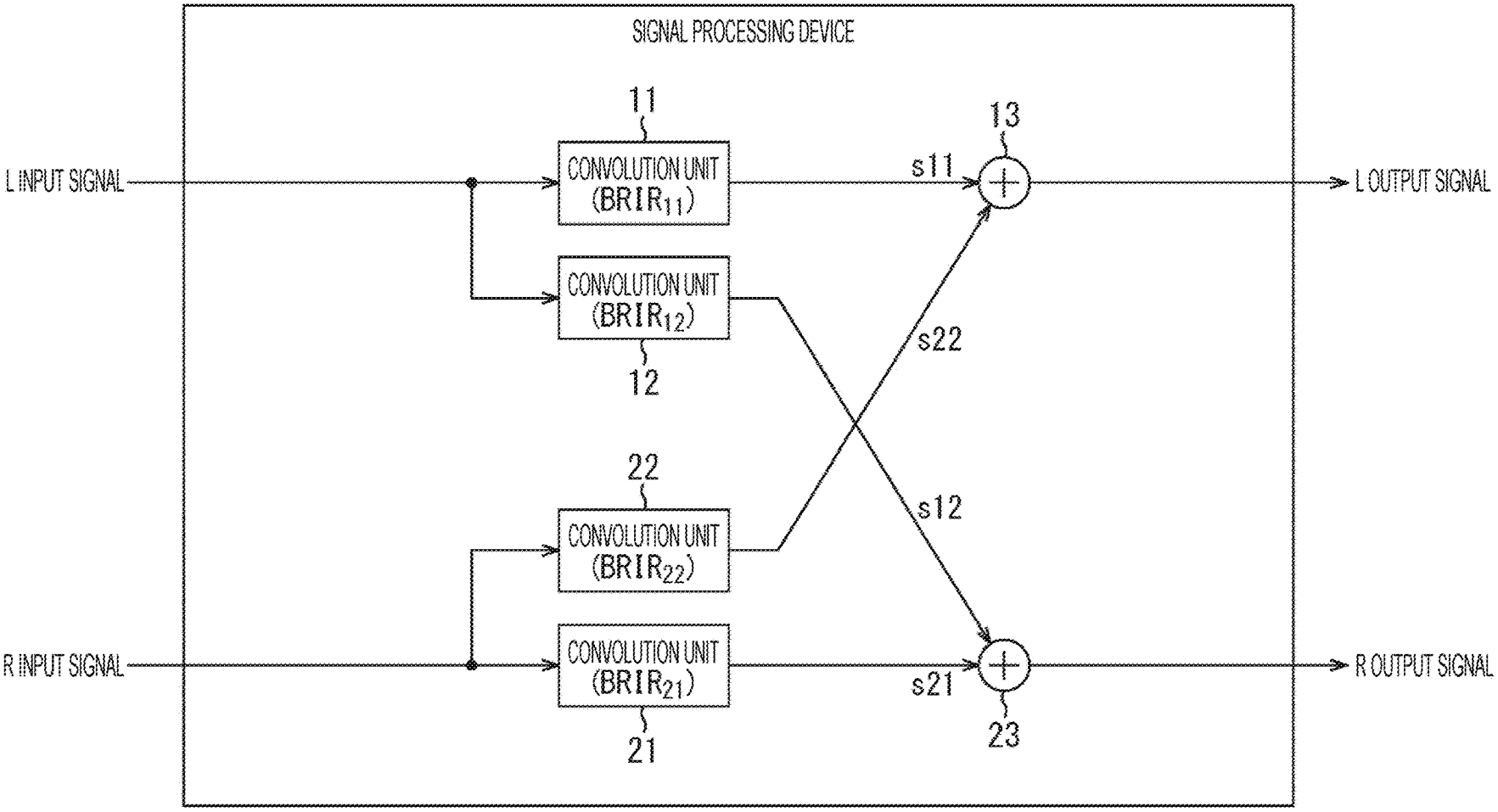
FIG. 1 is a block diagram illustrating a configuration example of a signal processing device to which the present technology can be applied.

FIG. 1 is a block diagram illustrating a configuration example of a signal processing device to which the present technology can be applied.

In FIG. 1, the signal processing device reproduces a sound field of, for example, a listening room, a stadium, a movie theater, a concert hall, or the like through replay by headphone by performing headphone virtual sound field processing on audio signals as targets. The headphone virtual sound field processing includes, for example, technologies such as Virtual Phone Technology (VPT) by Sony Corporation and Dolby Headphones by Dolby Laboratories, Inc.

Note that in the present embodiment, the replay by headphone includes, in addition to listening to audio (sound) using headphones, listening to audio using an audio output device such as an earphone or a neck speaker that is used in contact with the human ear, and an audio output device that is used in close proximity to the human ear.

In the headphone virtual sound field processing, a binaural-room impulse response (BRIR) obtained by convolving a room impulse response (RIR) and a head-related impulse response (HRIR) of a listener or the like is convolved into an audio signal of a sound source, to thereby (virtually) reproduce any sound field.

The RIR is an impulse response that represents acoustic transmission characteristics, for example, from the position of the sound source such as a speaker to the position of the listener (listening position) in the sound field, and differs depending on the sound field. The HRIR is an impulse response from the sound source to the ear of the listener, and differs depending on the listener (person).

The BRIR can be obtained, for example, by individually obtaining the RIR and the HRIR by means such as measurement and acoustic simulation, and convolving them by calculation processing.

Furthermore, the BRIR can be obtained, for example, by directly measuring using a dummy head the sound field reproduced by the headphone virtual sound field processing.

Note that the sound field reproduced by the headphone virtual sound field processing does not have to be a sound field that can be actually realized. Therefore, for example, (the RIR included in) the BRIR of the sound field can be obtained by arranging a plurality of virtual sound sources including direct sound and indirect sound in arbitrary directions and distances and designing a desired sound field itself. In this case, the BRIR can be obtained without designing the shape or the like of a sound field such as a concert hall where the sound field is formed.

The signal processing device of FIG. 1 has convolution units 11 and 12, an addition unit 13, convolution units 21 and 22, and an addition unit 23, and performs the headphone virtual sound field processing on audio signals of two channels, L channel and R channel, as targets.

Here, the audio signals of the L-channel and the R-channel that are targets of the headphone virtual sound field processing are also referred to as an L input signal and an R input signal, respectively.

The L input signal is supplied (input) to the convolution units 11 and 12, and the R input signal is supplied to the convolution units 21 and 22.

The convolution unit 11 functions as an input convolution signal generation unit that performs convolution (convolution integration) (convolution sum) of $BRIR_{11}$, which is obtained by convolving the HRIR from the sound source of the L input signal, for example, the speaker arranged on the left to the left ear of the listener and the RIR, and the L input signal to thereby generate an input convolution signal s11. The input convolution signal s11 is supplied from the convolution unit 11 to the addition unit 13.

Here, convolution of a time domain signal and an impulse response is equivalent to the product of a frequency domain signal obtained by converting the time domain signal into a frequency domain and a transfer function for the impulse response. Therefore, the convolution of the time domain signal and the impulse response in the present technology can be replaced by the product of the frequency domain signal and the transfer function.

The convolution unit 12 functions as an input convolution signal generation unit that performs convolution of $BRIR_{12}$, which is obtained by convolving the HRIR from the sound source of the L input signal to the right ear of the listener and the RIR, and the L input signal to thereby generate an input convolution signal s12. The input convolution signal s12 is supplied from the convolution unit 12 to the addition unit 23.

The addition unit 13 functions as an output signal generation unit that adds the input convolution signal s11 from the convolution unit 11 and an input convolution signal s22 from the convolution unit 22, to thereby generate an L output signal that is an output signal to the speaker of the L channel of the headphones. The L output signal is supplied from the addition unit 13 to the speaker of the L channel of the headphones that is not illustrated.

The convolution unit 21 functions as an input convolution signal generation unit that performs convolution of $BRIR_{21}$, which is obtained by convolving the HRIR from the sound source of the R input signal, for example, the speaker arranged on the right to the right ear of the listener and the RIR, and the R input signal to thereby generate an input convolution signal s21. The input convolution signal s21 is supplied from the convolution unit 21 to the addition unit 23.

The convolution unit 22 functions as an input convolution signal generation unit that performs convolution of $BRIR_{22}$, which is obtained by convolving the HRIR from the sound source of the R input signal to the left ear of the listener and the RIR, and the R input signal to thereby generate the input convolution signal s22. The input convolution signal s22 is supplied from the convolution unit 22 to the addition unit 13.

The addition unit 23 functions as an output signal generation unit that adds the input convolution signal s21 from the convolution unit 21 and the input convolution signal s12 from the convolution unit 12, to thereby generate an R output signal that is an output signal to the speaker of the R channel of the headphones. The R output signal is supplied from the addition unit 23 to the speaker of the R channel of the headphones that are not illustrated.

Incidentally, in two-channel stereo replay performed by arranging speakers, left and right speakers are arranged, for example, in directions in which the opening angle with respect to the center direction of the listener is 30 degrees to the left and right, and no speaker is placed in the center direction (front direction) of the listener. Accordingly, localization of audio (hereinafter, also referred to as a center sound image localization component) for which a sound source creator intends to localize a sound image in the center direction is performed by the phantom center localization.

That is, for example, with respect to the center sound image localization component such as a main vocal in popular music and performance of a soloist in a concerto of classical music, the sound image is localized in the center direction by replaying the same sound from the left and right speakers.

In a sound field in which the two-channel stereo replay as described above is performed, or in a sound field that imitates such a sound field by the headphone virtual sound field processing, an indirect sound that is sound other than the direct sound from the speakers is not symmetrical but has what is called asymmetry with respect to the listener. This left-right asymmetry of the indirect sound is important for making the listener feel spread of the sound, but on the other hand, if energy of the left-right asymmetric sound source becomes excessive, the phantom center localization is hindered and becomes sparse.

In a case where a sound field in a concert hall or the like, where there is a very large number of indirect sounds with respect to direct sounds compared to a studio or the like where a sound source is created, is reproduced by the headphone virtual sound field processing, the ratio of the direct sound that contributes to the phantom center localization to the entire sound source becomes significantly smaller than the ratio intended at the time of creating the sound source, and thus the phantom center localization becomes sparse.

That is, in a sound field with a relatively large number of indirect sounds, reverberation formed by the indirect sounds hinders the phantom center localization, and localization in the center direction by the phantom center localization of the center sound image localization component of the main vocal or the like becomes sparse.

If the localization in the center direction of the center sound image localization component becomes sparse, how (sounds corresponding to) the L output signal and R output signal obtained by the headphone virtual sound field processing is heard separates largely from, for example, how performance sound or the like of a soloist as a center sound image localization component experienced in an actual concert hall or the like is heard. As a result, realistic feeling is largely impaired.

Accordingly, in the present technology, the localization of the sound image in the center direction is stabilized in the headphone virtual sound field processing, thereby suppressing impairment of the realistic feeling.

<First Configuration Example of Signal Processing Device to which Present Technology is Applied>

Figure 2:
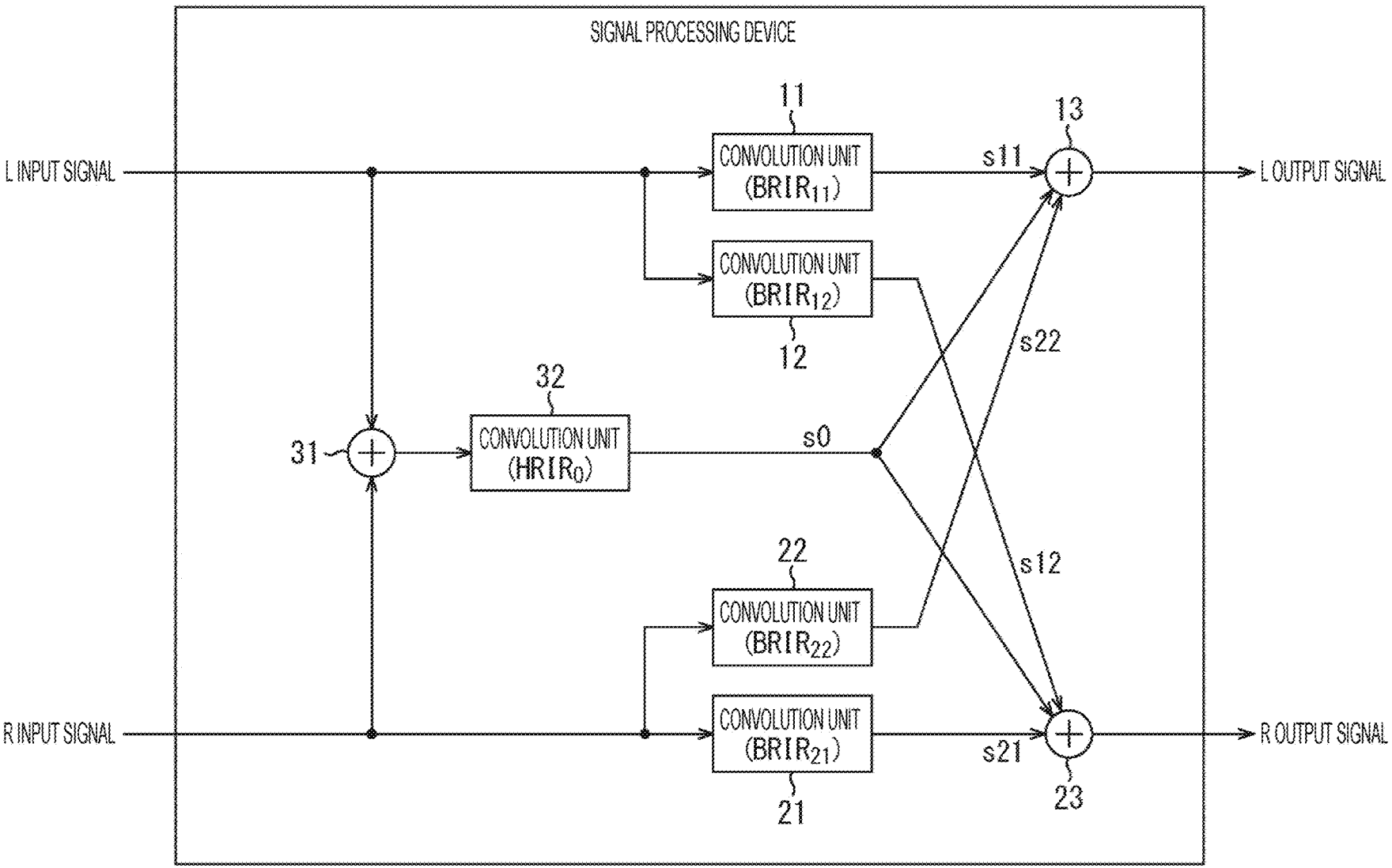
FIG. 2 is a block diagram illustrating a first configuration example of a signal processing device to which the present technology is applied.

FIG. 2 is a block diagram illustrating a first configuration example of a signal processing device to which the present technology is applied.

Note that in the diagram, parts corresponding to those in the case of FIG. 1 are designated by the same reference numerals, and the description thereof will be omitted as appropriate below.

The signal processing device of FIG. 2 has the convolution units 11 and 12, the addition unit 13, the convolution units 21 and 22, the addition unit 23, an addition unit 31, and a convolution unit 32.

Therefore, the signal processing device of FIG. 2 is common to the case of FIG. 1 in that it has the convolution units 11 and 12, the addition unit 13, the convolution units 21 and 22, and the addition unit 23.

However, the signal processing device of FIG. 2 is different from the case of FIG. 1 in that it newly has the addition unit 31 and the convolution unit 32.

Note that the signal processing device described below performs the headphone virtual sound field processing on audio signals of two channels, the L input signal and the R input signal, as targets. However, the present technology can be applied to the headphone virtual sound field processing for multi-channel audio signals that do not have a center-direction channel as targets, in addition to the audio signals of two channels.

Furthermore, the signal processing device described below can be applied to audio output devices such as headphones, earphones, and neck speakers. Moreover, the signal processing device can be applied to hardware audio players, software audio players (replay applications), servers that provide streaming of audio signals, and the like.

As described in FIG. 1, the phantom center localization is easily affected by indirect sound (reverberation), and formation of localization tends to be unstable. On the other hand, in the headphone virtual sound field processing, a sound source can be freely arranged in a virtual space.

Therefore, in the present technology, the sound image in the center direction is localized utilizing that the sound source can be freely arranged in (any direction or at any distance of) the virtual space in the headphone virtual sound field processing, instead of relying on the phantom center localization. That is, in the present technology, the sound source is arranged in the center direction, and a pseudo-center sound image localization component (hereinafter, also referred to as a pseudo-center component) is replayed (output) from the sound source, to thereby stably localize (the sound image of) the center sound image localization component in the center direction.

The localization of the pseudo-center component in the center direction utilizing the headphone virtual sound field processing can be performed by convolving (the sound source of) the pseudo-center component and $HRIR_0$ that is the HRIR in the center direction.

As the pseudo-center component, the sum of the L input signal and the R input signal can be used.

For example, in general, a vocal sound source material itself of popular music is recorded in monaural and is evenly allocated to the L channel and the R channel in order to achieve the phantom center localization. Therefore, the vocal sound source material is included as it is in the sum of the L input signal and the R input signal, and thus such a sum of the L input signal and the R input signal can be used as the pseudo-center component.

Furthermore, for example, the performance sound of a soloist in a concerto of classical music or the like is recorded by a spot microphone constituted of a pair of stereo microphones arranged with a distance of several centimeters separately from the accompaniment of the orchestra and is recorded by the spot microphone, and the performance sound recorded by the spot microphone is mixed by allocating to the L channel and the R channel. However, the distance between the pair of stereo microphones constituting the spot microphone is about several centimeters, which is relatively close. Therefore, a phase difference of audio signals from each other output from the pair of stereo microphones is small, and even if the sum of these audio signals is taken, it can be assumed that there is (almost) no adverse effect such as a change in sound quality by a comb-shaped filter effect and the like due to the phase difference. Thus, even in a case where the performance sound of the soloist recorded by the spot microphone is allocated to the L channel and the R channel, the sum of the L input signal and the R input signal can be used as the pseudo-center component.

In FIG. 2, the addition unit 31 functions as an addition signal generation unit that performs addition to take the sum of the L input signal and the R input signal and generates an addition signal that is the sum of the L input signal and the R input signal. The addition signal is supplied from the addition unit 31 to the convolution unit 32.

The convolution unit 32 functions as a center convolution signal generation unit that performs convolution of the addition signal from the addition unit 31 and the $HRIR_0$ (HRIR in the center direction) and generates a center convolution signal s0. The center convolution signal s0 is supplied from the convolution unit 32 to the addition units 13 and 23.

Note that the $HRIR_0$ used in the convolution unit 32 can be stored in a memory that is not illustrated and read from the memory into the convolution unit 32. Furthermore, the $HRIR_0$ can be stored in a server on the Internet or the like and downloaded from the server to the convolution unit 32. Moreover, as the $HRIR_0$ used in the convolution unit 32, for example, a general-purpose HRIR can be prepared. Furthermore, as the $HRIR_0$ used in the convolution unit 32, for example, HRIRs are prepared for each of a plurality of categories such as gender and age group, and HRIRs selected by the listener from the plurality of categories of HRIRs can be used in the convolution unit 32. Moreover, with respect to the $HRIR_0$ used in the convolution unit 32, the HRIR of the listener can be measured by some method, and the $HRIR_0$ used in the convolution unit 32 can be obtained from the HRIR. This similarly applies to the HRIRs used in a case of generating $BRIR_{11}$, $BRIR_{12}$, $BRIR_{21}$, and $BRIR_{22}$ used in the convolution units 11, 12, 21, and 22, respectively.

In the signal processing device of FIG. 2, the addition unit 31 adds the L input signal and the R input signal to generate an addition signal, and supplies the addition signal to the convolution unit 32. The convolution unit 32 performs convolution of the addition signal from the addition unit 31 and the $HRIR_0$ to generate the center convolution signal s0, and the center convolution signal s0 is supplied from the convolution unit 32 to the addition units 13 and 23.

On the other hand, the convolution unit 11 performs convolution of the L input signal and the $BRIR_{11}$ to generate the input convolution signal s11, and supplies the input convolution signal s11 to the addition unit 13.

The convolution unit 12 performs convolution of the L input signal and the $BRIR_{12}$ to generate the input convolution signal s12, and supplies the input convolution signal s12 to the addition unit 23.

The convolution unit 21 performs convolution of the R input signal and the $BRIR_{21}$ to generate the input convolution signal s21, and supplies the input convolution signal s21 to the addition unit 23.

The convolution unit 22 performs convolution of the R input signal and the $BRIR_{22}$ to generate the input convolution signal s22, and supplies the input convolution signal s22 to the addition unit 13.

The addition unit 13 adds the input convolution signal s11 from the convolution unit 11, the input convolution signal s22 from the convolution unit 22, and the center convolution signal s0 from the convolution unit 32, to thereby generate the L output signal. The L output signal is supplied from the addition unit 13 to the speaker of the L channel of the headphones that is not illustrated.

The addition unit 23 adds the input convolution signal s21 from the convolution unit 21, the input convolution signal s12 from the convolution unit 12, and the center convolution signal s0 from the convolution unit 32, to thereby generate the R output signal. The R output signal is supplied from the addition unit 23 to the speaker of the R channel of the headphones that are not illustrated.

As described above, in the signal processing device of FIG. 2, the L input signal and the R input signal are added to generate the addition signal. Moreover, convolution of the addition signal and the $HRIR_0$, which is the HRIR in the center direction, is performed to generate the center convolution signal s0. Furthermore, convolution of the L input signal and each of the $BRIR_{11}$ and the $BRIR_{12}$ is performed to generate the input convolution signals s11 and s12, and convolution of the R input signal and each of the $BRIR_{21}$ and the $BRIR_{22}$ is performed to generate the input convolution signals s21 and s22. Then, the center convolution signal s0 and the input convolution signals s11 and s22 are added to generate the L output signal, and the center convolution signal s0 and the input convolution signals s21 and s12 are added to generate the R output signal.

Therefore, with the signal processing device of FIG. 2, for example, the pseudo-center component (pseudo-center component) of the center sound image localization component, such as a main vocal that is evenly allocated to the L input signal and the R input signal and recorded in monaural, or a performance sound of a soloist that is recorded by the spot microphone and allocated to the L input signal and the R input signal, is stably localized in the center direction. Consequently, it is possible to suppress the loss of realistic feeling due to that the localization of the center sound image localization component in the center direction becomes sparse.

The signal processing device of FIG. 2 can stably localize the pseudo-center component in the center direction even in a case of reproducing, for example, a sound field in which the amount of reverberation is large and the phantom center localization becomes sparse due to the influence of the reverberation, such as a concert hall, by the headphone virtual sound field processing. That is, with the signal processing device of FIG. 2, the pseudo-center component can be stably localized in the center direction regardless of the reverberation.

Incidentally, the L input signal and the R input signal may include a component having a low cross-correlation (hereinafter, also referred to as a low-correlation component). The addition signal obtained by adding the L input signal and the R input signal including the low-correlation component includes, in addition to the center sound image localization component, the low-correlation component included in the L input signal and the low-correlation component included in the R input signal. Therefore, in the signal processing device of FIG. 2, in addition to the center sound image localization component, the low-correlation component is also localized in the center direction and replayed from the center direction (the sound is heard as if it is emitted from the center direction).

If the low-correlation component is replayed from the center direction, feeling of left-right spreading and feeling of being surrounded deteriorate.

Accordingly, the signal processing device that suppresses deterioration of the feeling of left-right spreading and the feeling of being surrounded will be described.

<Second Configuration Example of Signal Processing Device to which Present Technology is Applied>

Figure 3:
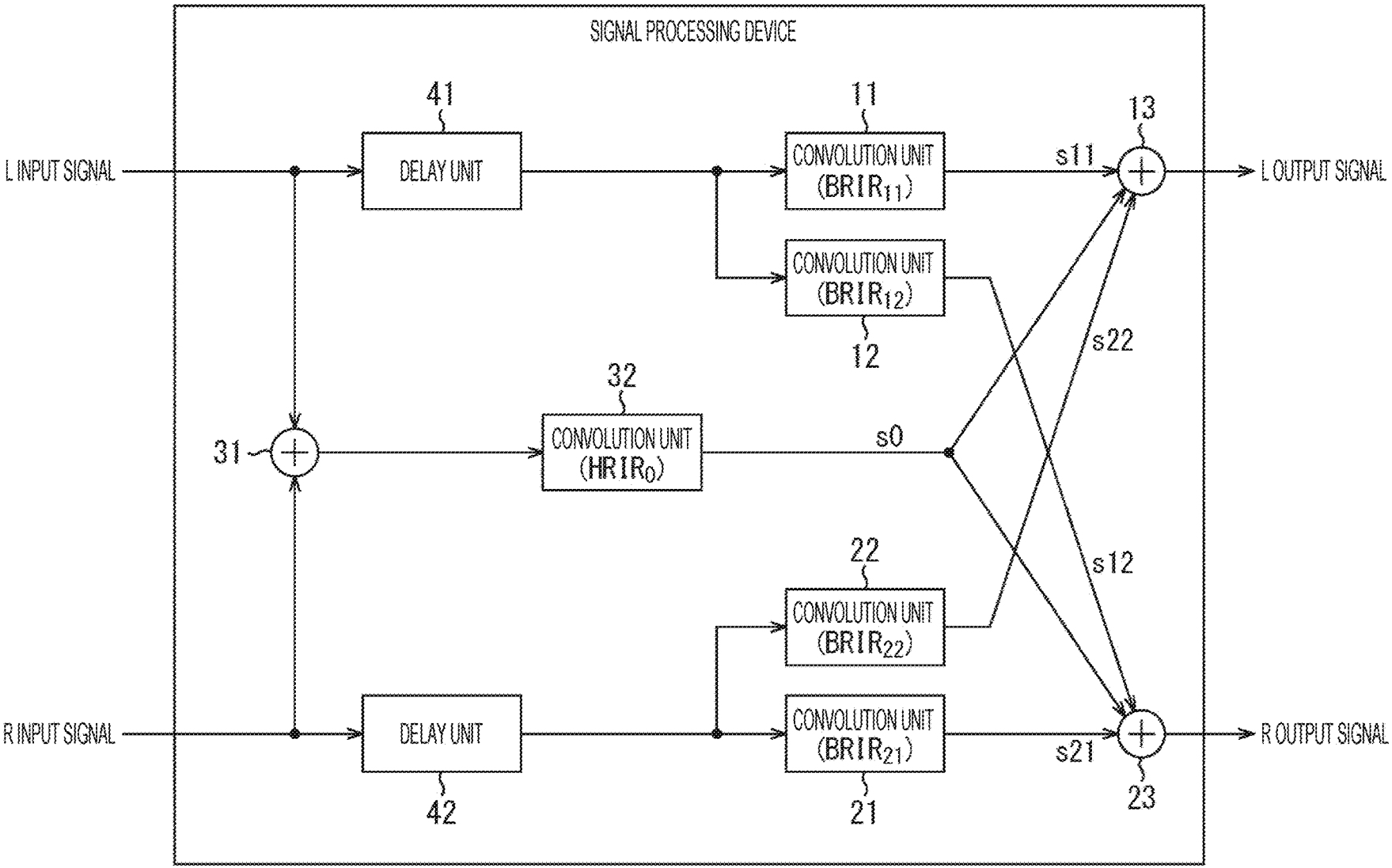
FIG. 3 is a block diagram illustrating a second configuration example of the signal processing device to which the present technology is applied.

FIG. 3 is a block diagram illustrating a second configuration example of the signal processing device to which the present technology is applied.

Note that in the diagram, parts corresponding to those in the case of FIG. 2 are designated by the same reference numerals, and the description thereof will be omitted as appropriate below.

The signal processing device of FIG. 3 has the convolution units 11 and 12, the addition unit 13, the convolution units 21 and 22, the addition unit 23, the addition unit 31, the convolution unit 32, and delay units 41 and 42.

Therefore, the signal processing device of FIG. 3 is common to the case of FIG. 2 in that it has the convolution units 11 and 12, the addition unit 13, the convolution units 21 and 22, the addition unit 23, the addition unit 31, and the convolution unit 32.

However, the signal processing device of FIG. 3 is different from the case of FIG. 2 in that it newly has the delay units 41 and 42.

The L input signal and the R input signal are supplied to the delay units 41 and 42, respectively. The delay unit 41 supplies the L input signal to the convolution units 11 and 12 with a delay by a predetermined time, for example, several milliseconds to several tens of milliseconds, or the like. The delay unit 42 supplies the R input signal to the convolution units 21 and 22 with a delay by the same time as that of the delay unit 41.

Therefore, in the signal processing device of FIG. 3, the L output signal obtained by the addition unit 13 is a signal in which the center convolution signal s0 precedes the input convolution signal s11 and the input convolution signal s22. Similarly, the R output signal obtained by the addition unit 23 is a signal in which the center convolution signal s0 precedes the input convolution signal s21 and the input convolution signal s12.

That is, in the signal processing device of FIG. 3, the vocal or the like corresponding to the addition signal as the pseudo-center component is replayed by preceding the direct sound and the indirect sound corresponding to the L input signal and the R input signal by several milliseconds to several tens of milliseconds.

Consequently, the localization of the addition signal in the center direction as the pseudo-center component can be improved by a preceding sound effect.

By the preceding sound effect, the addition signal can be localized in the center direction by the addition signal of smaller level as compared with a case where there is no preceding sound effect (in a case where there are no delay units 41 and 42).

Therefore, it is possible to suppress deterioration of the feeling of left-right spreading and the feeling of being surrounded due to the low-correlation component included in the addition signal by adjusting the level of the addition signal (including the center convolution signal s0 that is the addition signal having subjected to convolution with the $HRIR_0$) at the addition unit 31, the convolution unit 32, or any other position to a minimum level at which the localization in the center direction of the center sound image localization component included in the addition signal is perceived.

<Third Configuration Example of Signal Processing Device to which Present Technology is Applied>

Figure 4:
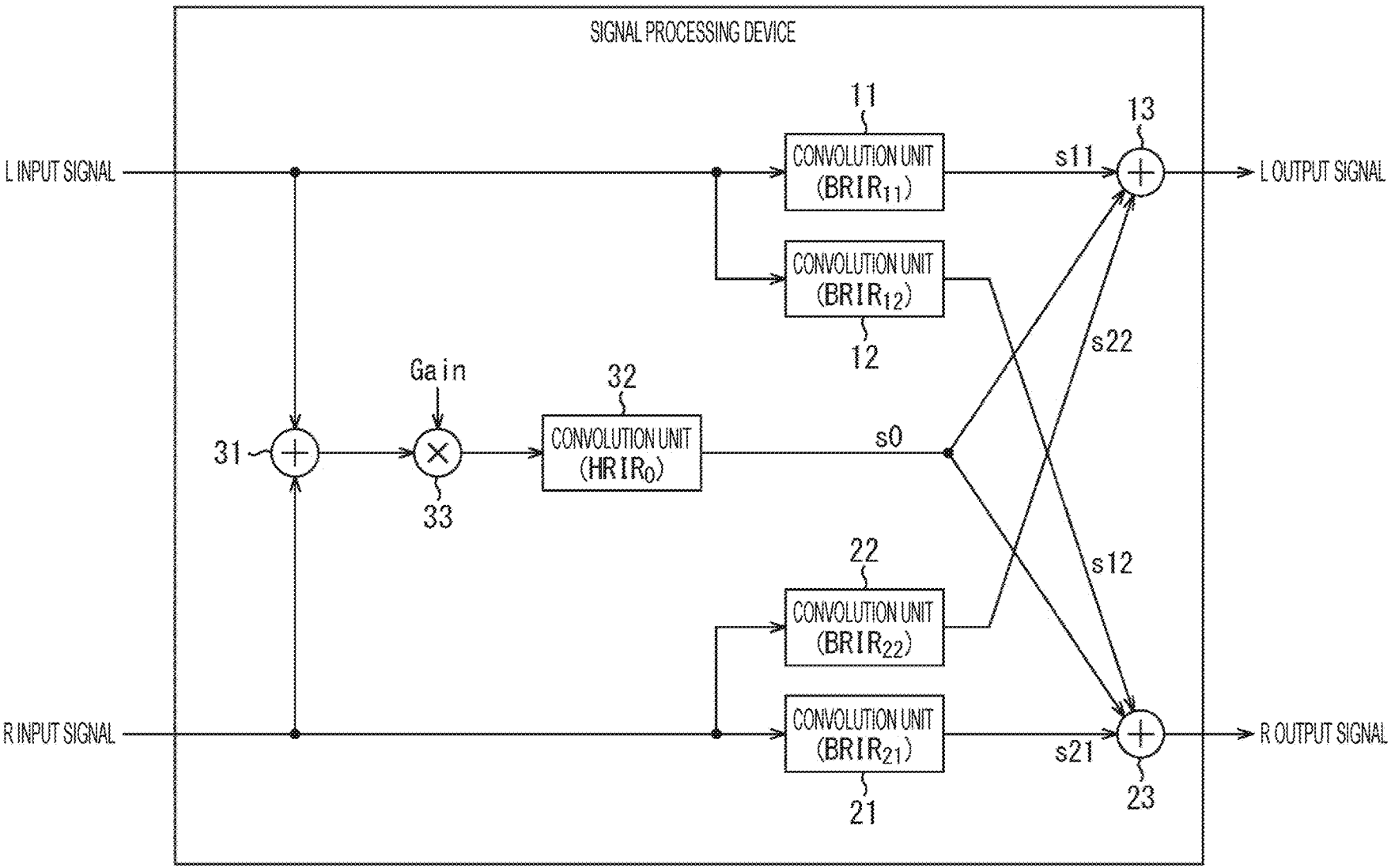
FIG. 4 is a block diagram illustrating a third configuration example of the signal processing device to which the present technology is applied.

FIG. 4 is a block diagram illustrating a third configuration example of the signal processing device to which the present technology is applied.

Note that in the diagram, parts corresponding to those in the case of FIG. 2 are designated by the same reference numerals, and the description thereof will be omitted as appropriate below.

The signal processing device of FIG. 4 has the convolution units 11 and 12, the addition unit 13, the convolution units 21 and 22, the addition unit 23, the addition unit 31, the convolution unit 32, and a multiplication unit 33.

Therefore, the signal processing device of FIG. 4 is common to the case of FIG. 2 in that it has the convolution units 11 and 12, the addition unit 13, the convolution units 21 and 22, the addition unit 23, the addition unit 31, and the convolution unit 32.

However, the signal processing device of FIG. 4 is different from the case of FIG. 2 in that it newly has the multiplication unit 33.

An addition signal as the pseudo-center component is supplied to the multiplication unit 33 from the addition unit 31. The multiplication unit 33 functions as a gain unit that adjusts the level of the addition signal by applying a predetermined gain to the addition signal from the addition unit 31. The addition signal to which the predetermined gain is applied is supplied from the multiplication unit 33 to the convolution unit 32.

In the signal processing device of FIG. 4, the multiplication unit 33 applies the predetermined gain to the addition signal from the addition unit 31 to thereby adjust, for example, the level of the addition signal to the minimum level at which the localization of the center sound image localization component included in the addition signal in the center direction is perceived, and supplies the adjusted addition signal to the convolution unit 32.

Therefore, by the signal processing device of FIG. 4, it is possible to suppress deterioration of the feeling of left-right spreading and the feeling of being surrounded due to the low-correlation component included in the addition signal.

<Fourth Configuration Example of Signal Processing Device to which Present Technology is Applied>

Figure 5:
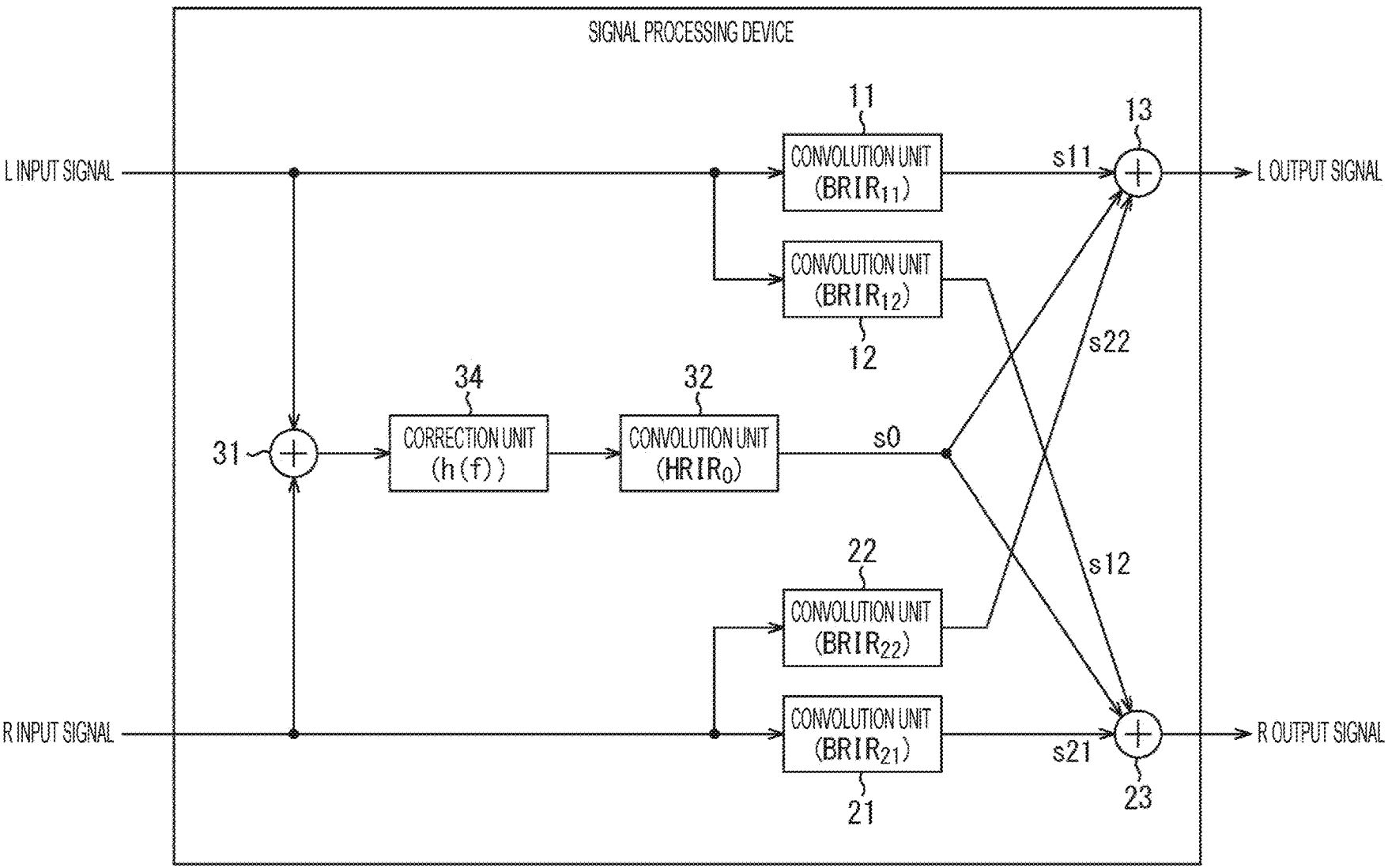
FIG. 5 is a block diagram illustrating a fourth configuration example of the signal processing device to which the present technology is applied.

FIG. 5 is a block diagram illustrating a fourth configuration example of the signal processing device to which the present technology is applied.

Note that in the diagram, parts corresponding to those in the case of FIG. 2 are designated by the same reference numerals, and the description thereof will be omitted as appropriate below.

The signal processing device of FIG. 5 has the convolution units 11 and 12, the addition unit 13, the convolution units 21 and 22, the addition unit 23, the addition unit 31, the convolution unit 32, and a correction unit 34.

Therefore, the signal processing device of FIG. 5 is common to the case of FIG. 2 in that it has the convolution units 11 and 12, the addition unit 13, the convolution units 21 and 22, the addition unit 23, the addition unit 31, and the convolution unit 32.

However, the signal processing device of FIG. 5 is different from the case of FIG. 2 in that it newly has the correction unit 34.

The addition signal as the pseudo-center component is supplied to the correction unit 34 from the addition unit 31. The correction unit 34 corrects the addition signal from the addition unit 31 and supplies the addition signal to the convolution unit 32.

That is, for example, the correction unit 34 corrects the addition signal from the addition unit 31 so as to compensate for an amplitude characteristic of the $HRIR_0$ to be subjected to convolution with the addition signal in the convolution unit 32, and supplies the corrected addition signal to the convolution unit 32.

Here, in a case where the pseudo-center component is localized in the center direction, for example, the center sound image localization component of the sound source created on the premise that it will be replayed (output) from the left and right speakers arranged on the left and right of the listener is replayed from the center direction.

That is, the center sound image localization component to be subjected to the convolution with the HRIR from the left and right speakers to the ears of the listener, that is, the HRIR included in the $BRIR_{11}$, $BRIR_{12}$, $BRIR_{21}$, and $BRIR_{22}$ is convolved with the $HRIR_0$ in the center direction, and is output in the form of being included in the L output signal and the R output signal.

Therefore, sound quality of the center sound image localization component (center convolution signal s0) included in the L output signal and the R output signal obtained by performing convolution of the center sound image localization component and the $HRIR_0$ in the center direction changes from sound quality of the center sound image localization component that the creator intended at the time of creation, for which the sound source is created on the premise that it will be replayed from the left and right speakers.

Specifically, regarding the center sound image localization component that forms the phantom center localization in the sound source used for two-channel stereo replay, for example, the sound quality is adjusted on the premise that it will be replayed from (the positions of) the left and right speakers that are arranged in directions in which the opening angle with respect to the center direction of the listener is 30 degrees to the left and right.

If the addition signal as the pseudo-center component that is the pseudo-center sound image localization component is generated by adding the L input signal and the R input signal for the sound source produced on such a premise, and the pseudo-center component is replayed from the center direction (direction with the opening angle of 0 degrees) by convolution with the $HRIR_0$ in the center direction (direction with the opening angle of 0 degrees), an azimuth seen from the listener at the replay position where the center sound image localization component included in the pseudo-center component is replayed is in the center direction, which is different from the directions of the left and right speakers.

Frequency characteristics determined by the HRIR (frequency characteristics with respect to the HRIR) differ depending on the azimuth seen from the listener. Thus, if (the pseudo-center component including) the center sound image localization component on the premise that it will be replayed from the left and right speakers is replayed from the center direction, the sound quality of the center sound image localization component replayed from the center direction becomes different from the sound quality intended by the creator on the premise that it is replayed from the left and right speakers.

Figure 6:
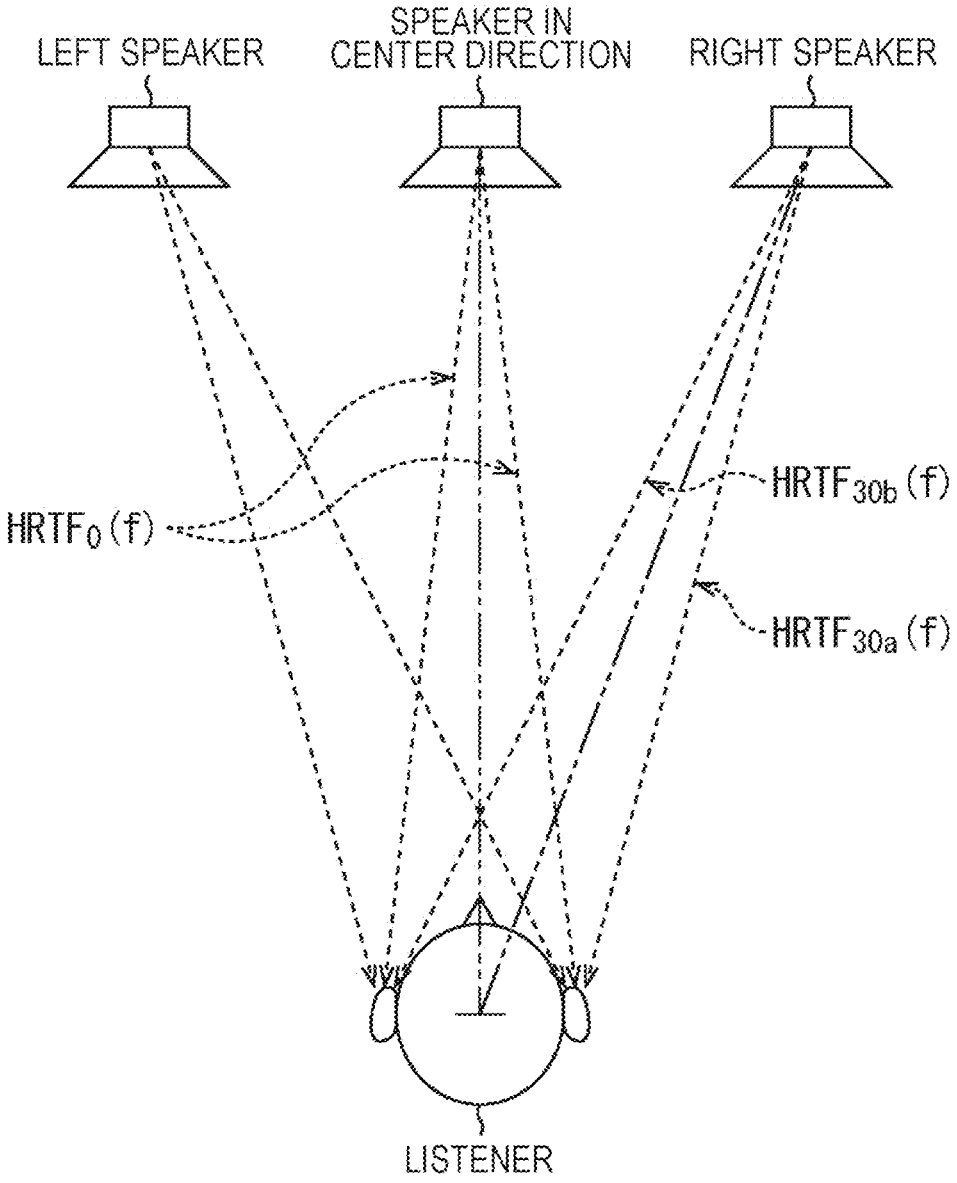
FIG. 6 is a diagram illustrating transmission paths of audio from each of left and right speakers and a speaker in a center direction to the ears of a listener.

FIG. 6 is a diagram illustrating transmission paths of audio from each of the left and right speakers and the speaker in the center direction to the ears of the listener.

In FIG. 6, a speaker as a sound source is arranged in each of the center direction of the listener, the direction in which the opening angle with respect to the center direction of the listener is 30 degrees to the right, and the direction in which the opening angle is 30 degrees to the left.

A head related transfer function (HRTF) for the HRIR of a transmission path from the right speaker to the ear of the listener on a sunny side (the same side as the right speaker) is expressed as $HRTF_{30a}(f)$. f represents a frequency. $HRTF_{30a}(f)$ represents, for example, a transfer function for the HRIR included in the $BRIR_{21}$.

Furthermore, the HRTF for the HRIR of a transmission path from the right speaker to the shade-side ear of the listener (the side different from the right speaker) is expressed as $HRTF_{30b}(f)$. The $HRTF_{30b}(f)$ represents, for example, a transfer function for the HRIR included in the $BRIR_{22}$.

Moreover, the HRTF for the HRIR of a transmission path from the speaker in the center direction to the right ear of the listener is expressed as $HRTF_0(f)$. The $HRTF_0(f)$ represents, for example, a transfer function for the $HRIR_0$.

Now, for simplicity of description, it is assumed that the HRTF (HRIR) is axisymmetric with respect to the center direction of the listener. In this case, the HRTF of a transmission path from the speaker in the center direction to the left ear of the listener is represented by $HRTF_0(f)$. Moreover, the HRTF of a transmission path from the left speaker to the sunny-side ear (left ear) of the listener is represented by $HRTF_{30a}(f)$, and the HRTF of a transmission path from the left speaker to the shade-side ear (right ear) of the listener is represented by $HRTF_{30b}(f)$.

Figure 7:
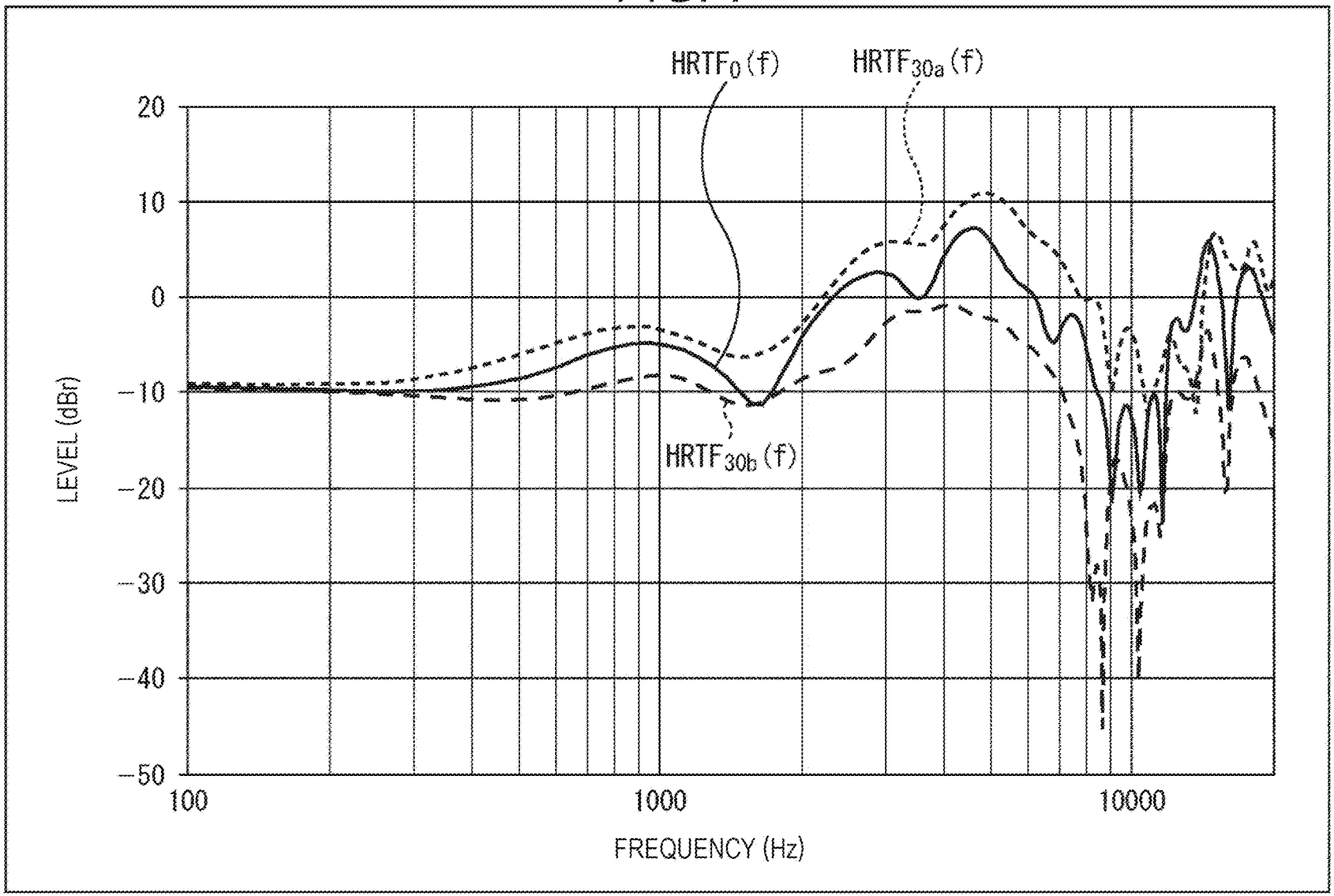
FIG. 7 is a diagram illustrating an example of frequency characteristics (amplitude characteristics) of $HRTF_0(f)$. $HRTF_{30a}(f)$ and $HRTF_{30b}(f)$.

FIG. 7 is a diagram illustrating an example of frequency characteristics (amplitude characteristics) of $HRTF_0(f)$. $HRTF_{30a}(f)$, and $HRTF_{30b}(f)$.

As illustrated in FIG. 7, the frequency characteristics of $HRTF_0(f)$. $HRTF_{30a}(f)$, and $HRTF_{30b}(f)$ are significantly different.

Thus, if the center sound image localization component to be subjected to the convolution with the HRIR (HRIR included in the $BRIR_{11}$, $BRIR_{12}$, $BRIR_{21}$, and $BRIR_{22}$) for $HRTF_{30a}(f)$ or $HRTF_{30b}(f)$ is convolved with the $HRIR_0$ for $HRTF_0(f)$, and is output in the form of being included in the L output signal and R output signal, sound quality of the center sound image localization component (center convolution signal s0) included in the L output signal and R output signal changes from sound quality of the center sound image localization component that the creator intended at the time of creation for which the sound source is created on the premise that it will be replayed from the left and right speakers.

Accordingly, the correction unit 34 corrects the addition signal as a pseudo-center signal from the addition unit 31 so as to compensate for the amplitude characteristic of the $HRIR_0$ (relative to the $HRTF_0(f)$), thereby suppressing changes in the sound quality of the center sound image localization component.

For example, the correction unit 34 performs convolution of the addition signal as the pseudo-center signal and an impulse response to a transfer function h(f) as a correction characteristic represented by Equation (1), Equation (2), or Equation (3), thereby correcting the addition signal as the pseudo-center signal.

$$h(f)=\alpha|HRTF_{30a}(f)|/|HRTF_0(f)| \quad (1)$$

$$h(f)=\alpha(|HRTF_{30a}(f)|+|HRTF_{30b}(f)|)/(2|HRTF_0(f)|) \quad (2)$$

$$h(f)=\alpha/|HRTF_0(f) \quad (3)$$

Here, in Equations (1) to (3), a is a parameter for adjusting the degree of correction by the correction unit 34, and is set to a value in the range of 0 to 1. Furthermore, for example, the HRTF of the listener himself or herself can be employed or the average HRTF of a plurality of persons can be employed as the $HRTF_0(f)$, $HRTF_{30a}(f)$, and $HRTF_{30b}(f)$ used for correction characteristics of Equations (1) to (3).

Note that as illustrated in FIG. 7, the level (amplitude) of the $HRTF_{30b}(f)$ on the shade side is lower than the level of $HRTF_{30a}(f)$ on the sunny side, and a degree of contribution of the $HRTF_{30b}(f)$ on the shade side to perception of sound quality by the listener is smaller than a degree of contribution of the $HRTF_{30a}(f)$ on the sunny side to the perception of the sound quality by the listener. Therefore, Equation (1) has a correction characteristic using only the $HRTF_{30a}(f)$ on the sunny side out of the $HRTF_{30b}(f)$ on the shade side and the $HRTF_{30a}(f)$ on the sunny side.

The correction by the correction unit 34 has a purpose of bringing characteristics of the center convolution signal s0 (center sound image localization component) obtained by convolution of the addition signal as the pseudo center signal and the $HRIR_0$ in the center direction closer to some target characteristics with good sound quality, and mitigating (suppressing) changes in sound quality due to convolution with the $HRIR_0$.

As the target characteristics, other than (the amplitude characteristics $|HRTF_{30a}(f)|$ of) the $HRTF_{30a}(f)$ on the sunny side as in Equation (1), the average value of the $HRTF_{30a}(f)$ and the $HRTF_{30b}(f)$ (the average value of the amplitude characteristics $|HRTF_{30a}(f)|$ and $|HRTF_{30b}(f)|$) as in Equation (2), and flat characteristics and the like over the entire frequency band as in Equation (3) can be employed. Furthermore, as the target characteristics, for example, a root mean square of the $HRTF_{30a}(f)$ and the $HRTF_{30b}(f)$ can be employed. Note that the correction by the correction unit 34 can be performed on the addition signal (center convolution signal s0) after convolution with the $HRIR_0$ as a target that is output by the convolution unit 32 besides performing on the addition signal supplied by the addition unit 31 to the convolution unit 32 as a target.

<Fifth Configuration Example of Signal Processing Device to which Present Technology is Applied>

Figure 8:
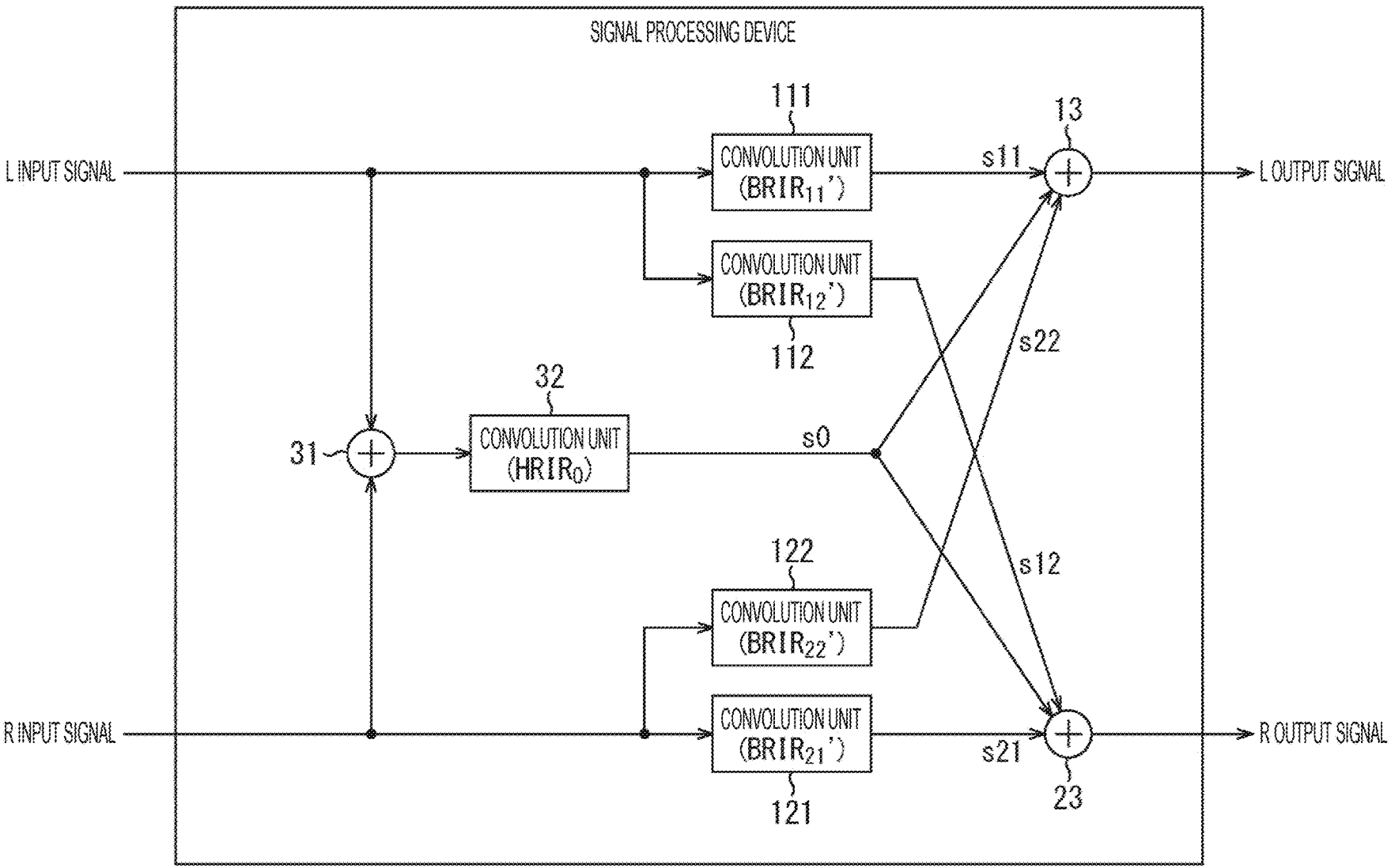
FIG. 8 is a block diagram illustrating a fifth configuration example of a signal processing device to which the present technology is applied.

FIG. 8 is a block diagram illustrating a fifth configuration example of the signal processing device to which the present technology is applied.

Note that in the diagram, parts corresponding to those in the case of FIG. 2 are designated by the same reference numerals, and the description thereof will be omitted as appropriate below.

The signal processing device of FIG. 8 has the addition unit 13, the addition unit 23, the addition unit 31, the convolution unit 32, convolution units 111 and 112, and convolution units 121 and 122.

Therefore, the signal processing device of FIG. 8 is common to the case of FIG. 2 in that it has the addition unit 13, the addition unit 23, the addition unit 31, and the convolution unit 32.

However, the signal processing device of FIG. 8 is different from the case of FIG. 2 in that it has the convolution units 111 and 112 and the convolution units 121 and 122 in place of the convolution units 11 and 12 and the convolution units 21 and 22, respectively.

The convolution unit 111 is configured similarly to the convolution unit 11 except that $BRIR_{11}'$ is convolved into the L input signal instead of the $BRIR_{11}$. The convolution unit 112 is configured similarly to the convolution unit 12 except that $BRIR_{12}'$ is convolved into the L input signal instead of the $BRIR_{12}$.

The convolution unit 121 is configured similarly to the convolution unit 21 except that $BRIR_{21}'$ is convolved into the R input signal instead of the $BRIR_{21}$. The convolution unit 122 is configured similarly to the convolution unit 22 except that $BRIR_{22}'$ is convolved into the L input signal instead of the $BRIR_{22}$.

The $BRIR_{11}'$, $BRIR_{12}'$, $BRIR_{21}'$, and $BRIR_{22}'$ include HRIR similar to the HRIR included in the $BRIR_{11}$, $BRIR_{12}$, $BRIR_{21}$, and $BRIR_{22}$.

However, the RIR included in the $BRIR_{11}'$, $BRIR_{12}'$, $BRIR_{21}'$, and $BRIR_{22}'$ is adjusted so that more indirect sounds for which the L input signal is a sound source come from the left side and also more indirect sounds for which the R input signal is a sound source come from the right side than in the RIR included in the $BRIR_{11}$, $BRIR_{12}$, $BRIR_{21}$, and $BRIR_{22}$.

That is, the RIR included in the $BRIR_{11}'$, $BRIR_{12}'$, $BRIR_{21}'$, and $BRIR_{22}'$ is adjusted so that more indirect sounds for which the L input signal is a sound source come from the left side than in the case of FIG. 1, that is, the case where only the input convolution signals s11, s12, s21, and s22 are used as the L output signal and the R output signal, and more indirect sounds for which the R input signal is a sound source come from the right side than in the case of FIG. 1.

In a case where the RIR is adjusted so that more indirect sounds for which the L input signal is a sound source come from the left side and also more indirect sounds for which the R input signal is a sound source come from the right side as described above, feeling of spreading and being surrounded when listening to (audio corresponding to) the L output signal and the R output signal is improved as compared with cases where such adjustment is not made.

Therefore, as described with reference to FIGS. 2 to 4, it is possible to improve the feeling of left-right spreading and the feeling of being surrounded due to the low-correlation component included in the addition signal as the pseudo-center component.

Here, the adjustment of the RIR that is performed so that more indirect sounds for which the L input signal is a sound source come from the left side and more indirect sounds for which the R input signal is a sound source come from the right side will be also referred to as indirect sound adjustment.

Figure 9:
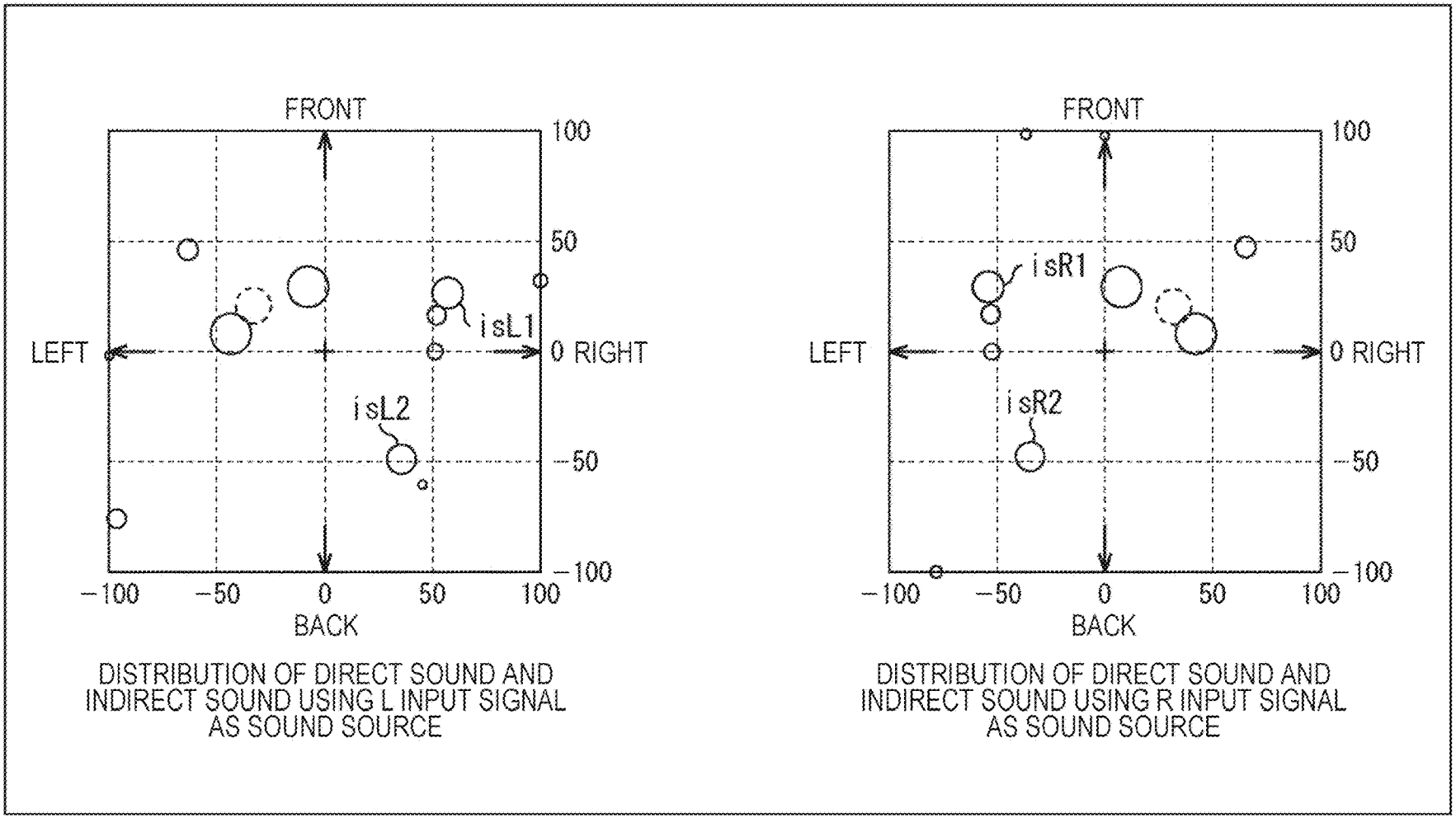
FIG. 9 is a diagram illustrating an example of a distribution of direct sounds and indirect sounds arriving at the listener by headphone virtual sound field processing in a case where indirect sound adjustment of RIR is not performed.

FIG. 9 is a diagram illustrating an example of a distribution of direct sounds and indirect sounds arriving at the listener by the headphone virtual sound field processing in a case where the indirect sound adjustment of the RIR is not performed.

That is, FIG. 9 illustrates the distribution of direct sounds and indirect sounds for which the L input signal and the R input signal are sound sources, which arrive at the listener in the headphone virtual sound field processing performed by the signal processing device of FIG. 1.

In FIG. 9, a dotted circle represents a direct sound, and a solid circle represents an indirect sound. The center position (the position marked with a plus) is the position of the listener. The size of a circle indicates magnitude (level) of the direct sound or indirect sound represented by the circle, and the distance from the center position to the circle indicates the time needed for the direct sound or indirect sound represented by the circle to reach the listener. This similarly applies to FIG. 10 as described later.

The RIR can be expressed, for example, in a form as illustrated in FIG. 9.

Figure 10:
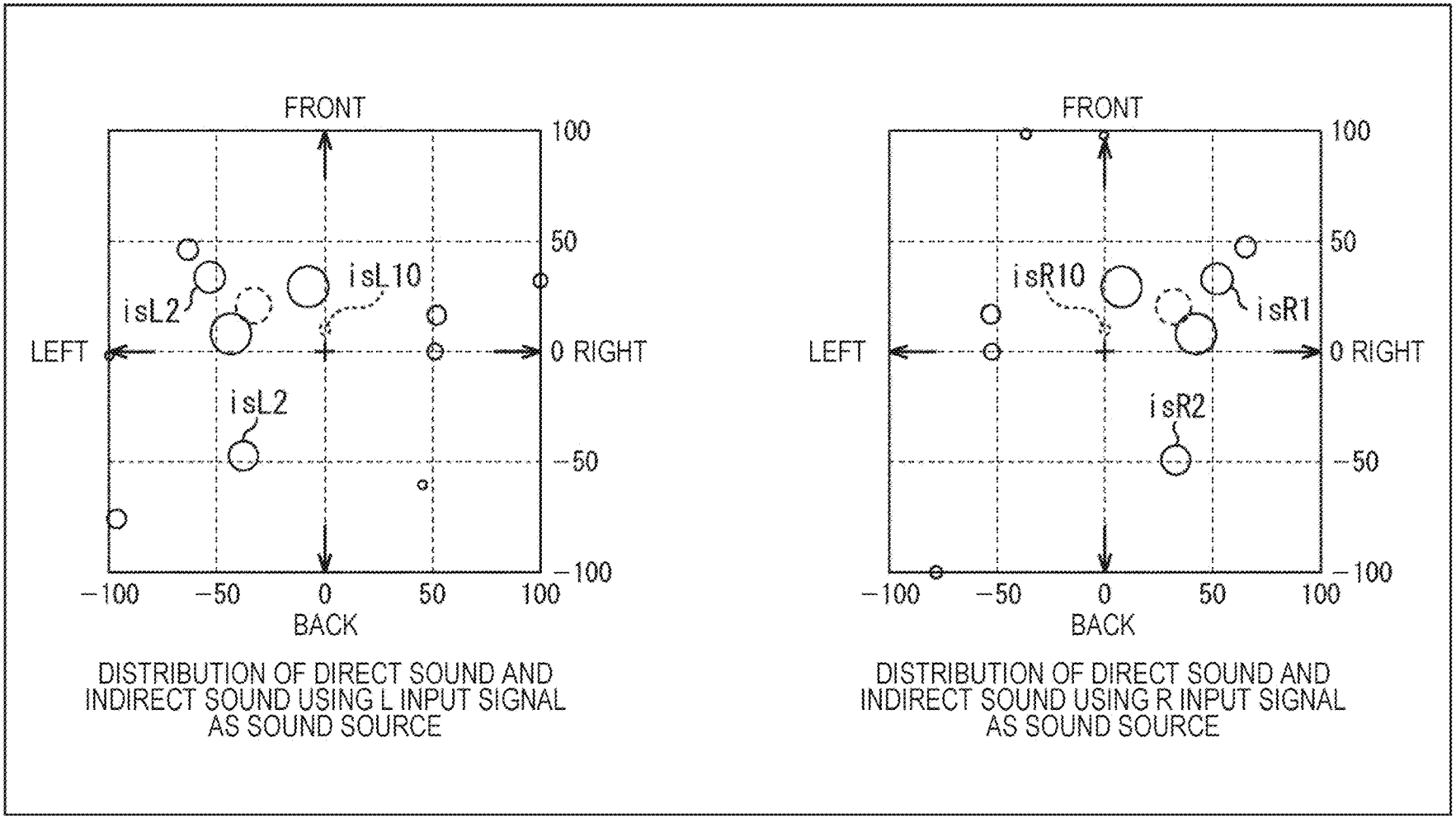
FIG. 10 is a diagram illustrating an example of a distribution of direct sounds and indirect sounds arriving at the listener by the headphone virtual sound field processing in a case where the indirect sound adjustment of the RIR is performed.

FIG. 10 is a diagram illustrating an example of a distribution of direct sounds and indirect sounds arriving at the listener by the headphone virtual sound field processing in a case where the indirect sound adjustment of the RIR is performed.

That is, FIG. 10 illustrates a distribution of direct sounds and indirect sounds for which the L input signal and the R input signal are sound sources, which arrive at the listener by the headphone virtual sound field processing performed by the signal processing device of FIG. 8.

In FIG. 10, pseudo-center components isL10 and isR10 are arranged so as to reach the listener earliest.

Moreover, in FIG. 9, the indirect sounds isL1 and isL2 for which the L input signal is a sound source, which arrive from the right side, are adjusted so as to arrive from the left side in FIG. 10. That is, the RIR is adjusted so that more indirect sounds for which the L input signal is a sound source come from the left side.

Furthermore, in FIG. 9, the indirect sounds isR1 and isR2 for which the R input signal is a sound source, which arrive from the left side, are adjusted so as to arrive from the right side in FIG. 10. That is, the RIR is adjusted so that more indirect sounds for which the R input signal is a sound source come from the right side.

Note that in the signal processing device of FIG. 2, as illustrated in FIGS. 3 to 5 and 8, besides that the delay units 41 and 42 of FIG. 3, the multiplication unit 33 of FIG. 4, the correction unit 34 of FIG. 5, or the convolution units 111, 112, 121, and 122 of FIG. 8 are provided, two or more of the delay units 41 and 42 of FIG. 3, the multiplication unit 33 of FIG. 4, the correction unit 34 of FIG. 5, and the convolution units 111, 112, 121, and 122 of FIG. 8 can be provided.

For example, the signal processing device of FIG. 2 can be provided with the delay units 41 and 42 of FIG. 3 and the multiplication unit 33 of FIG. 4.

In this case, by the preceding sound effect such that the addition signal as the pseudo-center component are replayed in advance due to delays of the L input signal and the R input signal by the delay units 41 and 42, localization of the addition signal as the pseudo-center component in the center direction improves. Then, the level of the addition signal is adjusted to the minimum level at which the localization of the center sound image localization component included in the addition signal in the center direction is perceived in the multiplication unit 33, and thus the feeling of left-right spreading and the feeling of being surrounded can be prevented from being deteriorated due to the low-correlation component included in the addition signal.

<Sixth Configuration Example of Signal Processing Device to which Present Technology is Applied>

Figure 11:
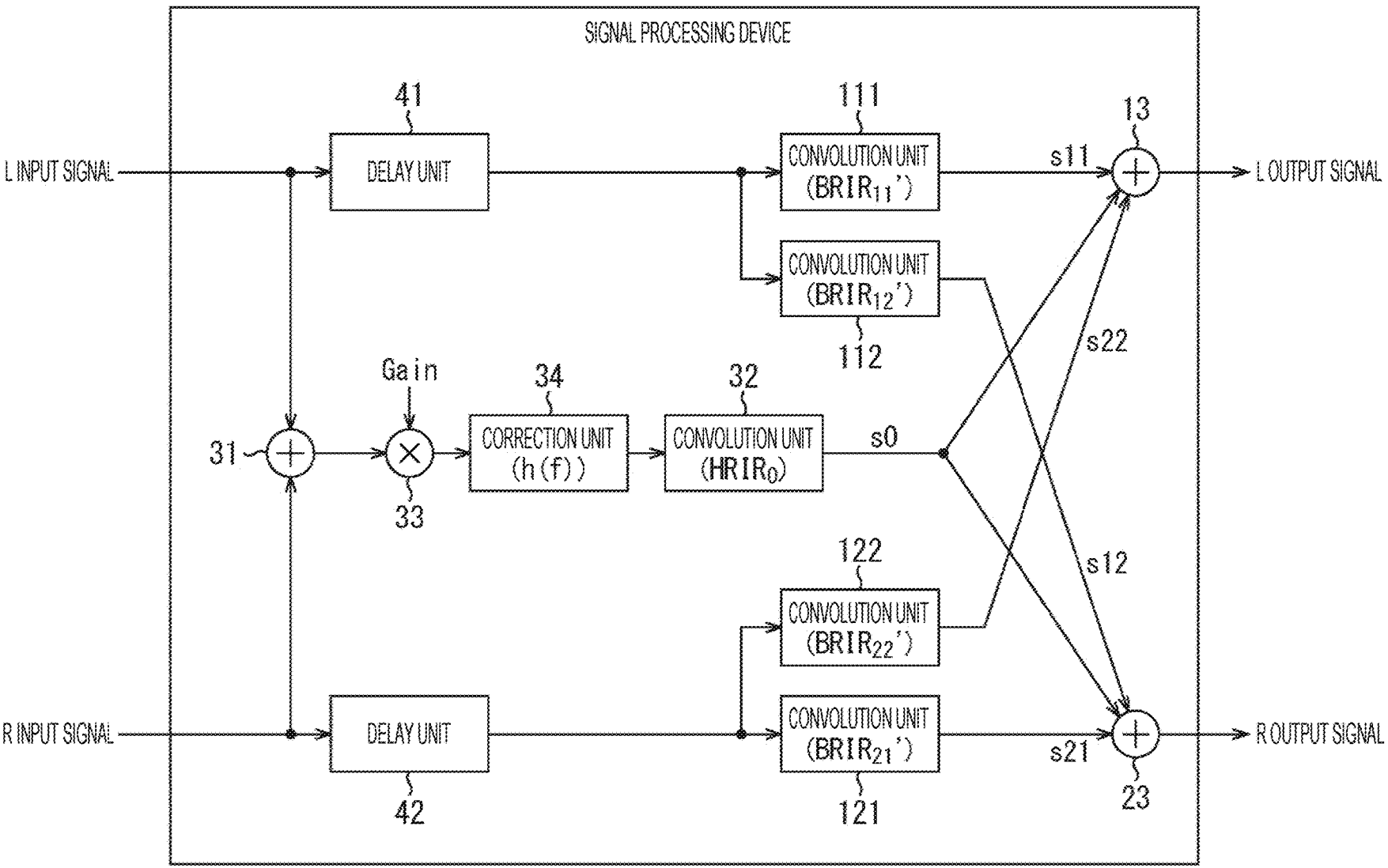
FIG. 11 is a block diagram illustrating a sixth configuration example of the signal processing device to which the present technology is applied.

FIG. 11 is a block diagram illustrating a sixth configuration example of the signal processing device to which the present technology is applied.

Note that in the diagram, parts corresponding to those in the cases of FIG. 2 to 5 or 8 are designated by the same reference numerals, and the description thereof will be omitted as appropriate below.

The signal processing device of FIG. 11 has the addition unit 13, the addition unit 23, the addition unit 31, the convolution unit 32, the multiplication unit 33, the correction unit 34, the delay units 41 and 42, the convolution units 111 and 112, and the convolution units 121 and 122.

Therefore, the signal processing device of FIG. 11 is common to the case of FIG. 2 in that it has the addition unit 13, the addition unit 23, the addition unit 31, and the convolution unit 32.

However, the signal processing device of FIG. 11 differs from the case of FIG. 2 in that it newly has the delay units 41 and 42 of FIG. 3, the multiplication unit 33 of FIG. 4, and the correction unit 34 of FIG. 5, and that it has the convolution units 111 and 112, and the convolution units 121 and 122 instead of the convolution units 11 and 12 and the convolution units 21 and 22, respectively.

That is, the signal processing device of FIG. 11 has a configuration such that the signal processing device of FIG. 2 includes the delay units 41 and 42 of FIG. 3, the multiplication unit 33 of FIG. 4, the correction unit 34 of FIG. 5, and the convolution units 111,112,121, and 122 of FIG. 8.

Figure 12:
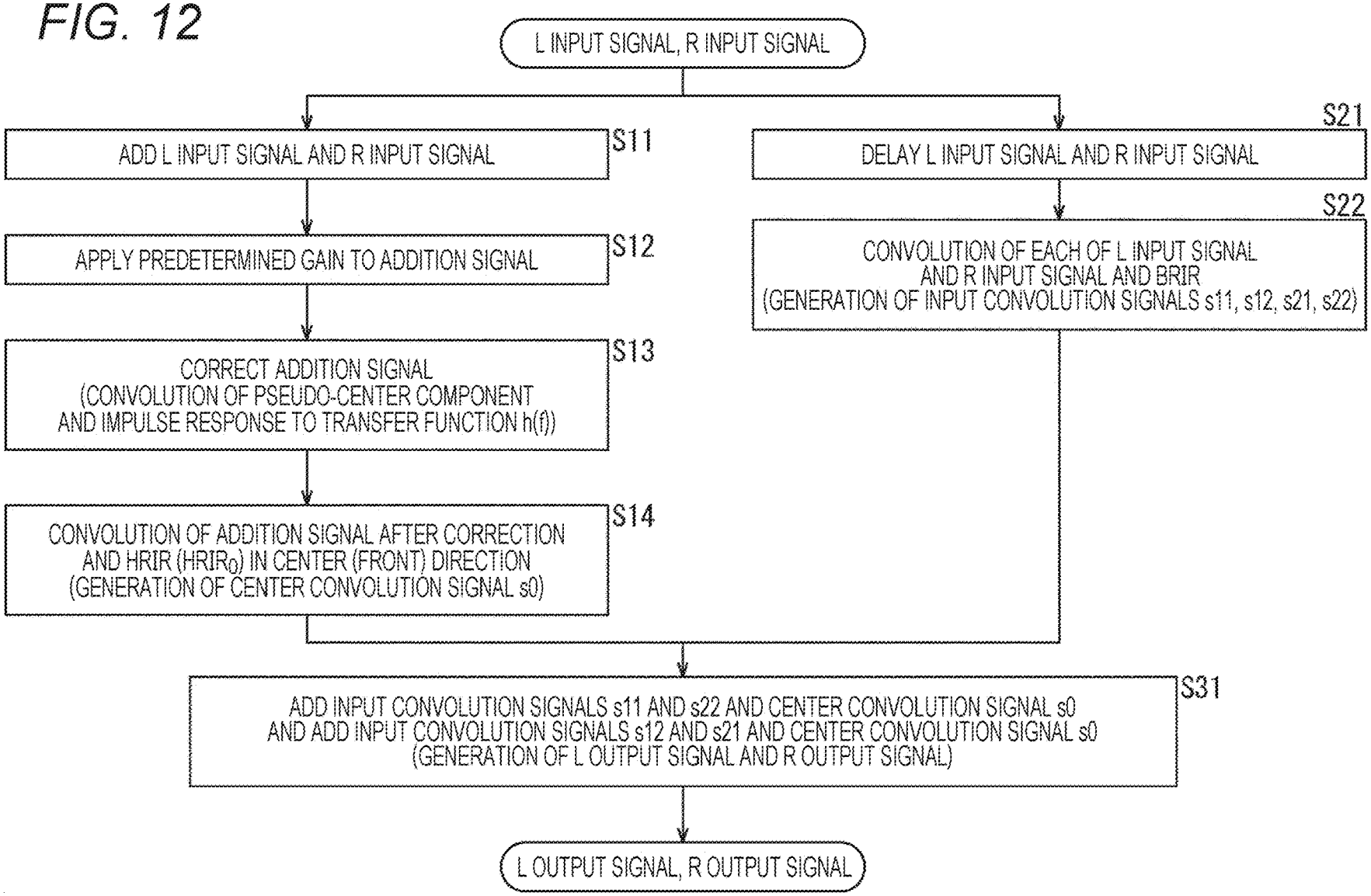
FIG. 12 is a flowchart describing operation of the signal processing device.

FIG. 12 is a flowchart illustrating operation of the signal processing device in FIG. 11.

In step S11, the addition unit 31 adds the L input signal and the R input signal to thereby generate the addition signal as the pseudo-center component. The addition unit 31 supplies the addition signal as the pseudo-center component to the multiplication unit 33, and the process proceeds from step S11 to step S12.

In step S12, the multiplication unit 33 adjusts the level of the addition signal by applying a predetermined gain to the addition signal as the pseudo-center component from the addition unit 31. The multiplication unit 33 supplies the addition signal as the pseudo-center component after adjusting the level to the correction unit 34, and the process proceeds from step S12 to step S13.

In step S13, the correction unit 34 corrects the addition signal as the pseudo-center component from the multiplication unit 33 according to, for example, the correction characteristics of any one of Equations (1) to (3). That is, the correction unit 34 performs convolution of the addition signal as the pseudo-center component and the impulse response to the transfer function h(f) of any one of Equations (1) and (3) to thereby correct the addition signal as the pseudo-center component. The correction unit 34 supplies the addition signal as the pseudo-center component after being corrected to the convolution unit 32, and the process proceeds from step S13 to step S14.

In step S14, the convolution unit 32 performs convolution of the addition signal as the pseudo-center component from the addition unit 31 and the $HRIR_0$, to thereby generate the center convolution signal s0. The convolution unit 32 supplies the center convolution signal s0 to the addition units 13 and 23, and the process proceeds from step S14 to step S31.

On the other hand, in step S21, the delay unit 41 supplies the L input signal to the convolution units 111 and 112 with a delay by a predetermined time, and the delay unit 42 supplies the R input signal to the convolution units 121 and 122 with a delay by a predetermined time.

Then, the process proceeds from step S21 to step S22, and the convolution unit 111 performs convolution of the $BRIR_{11}$' and the L input signal to thereby generate the input convolution signal s11, and supplies the input convolution signal s11 to the addition unit 13. The convolution unit 112 performs convolution of the $BRIR_{12}$' and the L input signal to thereby generate the input convolution signal s12, and supplies the input convolution signal s12 to the addition unit 23. The convolution unit 121 performs convolution of the $BRIR_{21}$' and the R input signal to thereby generate the input convolution signal s21, and supplies the input convolution signal s21 to the addition unit 23. The convolution unit 122 performs convolution of the $BRIR_{22}$' and the R input signal to thereby generate the input convolution signal s22, and supplies the input convolution signal s22 to the addition unit 13.

Then, the process proceeds from step S22 to step S31, and the addition unit 13 adds the input convolution signal s11 from the convolution unit 111, the input convolution signal s22 from the convolution unit 122, and the center convolution signal s0 from the convolution unit 32, to thereby generate the L output signal. Furthermore, the addition unit 23 adds the input convolution signal s21 from the convolution unit 121, the input convolution signal s12 from the convolution unit 112, and the center convolution signal s0 from the convolution unit 32, to thereby generate the R output signal.

According to the L output signal and R output signal as described above, the center sound image localization component (pseudo-center component) is stably localized in the center direction, and changes in the sound quality of the center sound image localization component and deterioration of the feeling of spreading and the feeling of being surrounded can be suppressed.

Description of Computer to which Present Technology is Applied>

Next, the series of processing of the signal processing devices of FIGS. 2 to 5, 8, and 11 can be performed by hardware or software. In a case where the series of processing is executed by software, a program constituting the software is installed in a computer or the like.

Figure 13:
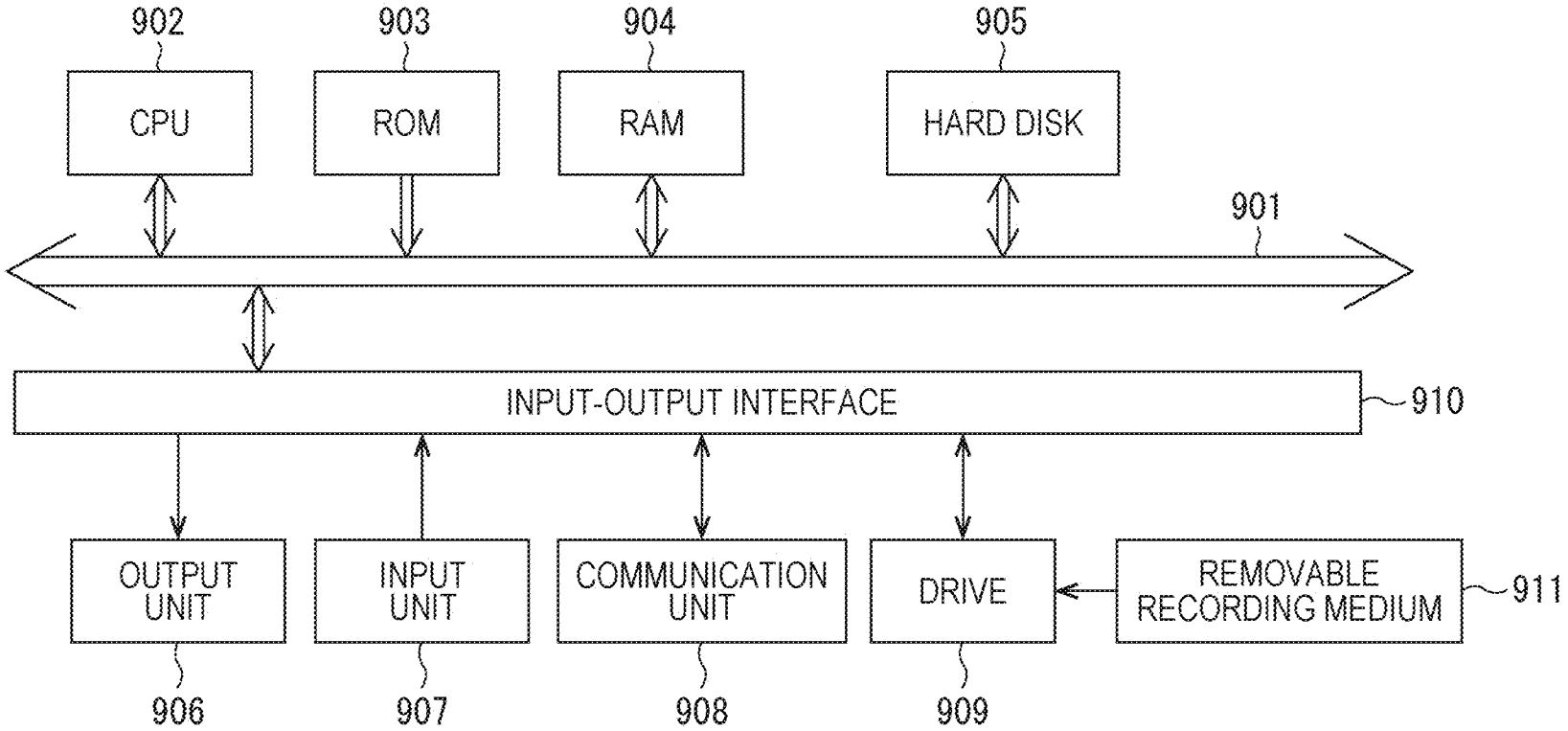
FIG. 13 is a block diagram illustrating a configuration example of an embodiment of a computer to which the present technology is applied.

FIG. 13 is a block diagram illustrating a configuration example of an embodiment of a computer on which a program for executing the above-described series of processing is installed.

The program can be pre-recorded on a hard disk 905 or ROM 903 as a recording medium incorporated in the computer.

Alternatively, the program can be stored (recorded) in a removable recording medium 911 driven by a drive 909. Such a removable recording medium 911 can be provided as what is called package software. Here, examples of the removable recording medium 911 include a flexible disk, a compact disc read only memory (CD-ROM), a magneto optical (MO) disk, a digital versatile disc (DVD), a magnetic disk, a semiconductor memory, and the like.

Note that in addition to installing the program on the computer from the removable recording medium 911 as described above, the program can be downloaded to the computer via a communication network or a broadcasting network and installed on the incorporated hard disk 905. That is, for example, the program can be transferred to the computer wirelessly from a download site via an artificial satellite for digital satellite broadcasting, or transferred to the computer by wire via a network such as a local area network (LAN) or the Internet.

The computer has an incorporated central processing unit (CPU) 902, and an input-output interface 910 is connected to the CPU 902 via a bus 901.

If a command is input by a user through the input-output interface 910 by operating an input unit 907 or the like, the CPU 902 executes the program stored in the ROM (Read Only Memory) 903 accordingly. Alternatively, the CPU 902 loads the program stored in the hard disk 905 into a random access memory (RAM) 904 and executes the program.

Thus, the CPU 902 performs the processing according to the above-described flowchart or the processing performed according to the above-described configuration of the block diagram. Then, the CPU 902 outputs a processing result thereof from an output unit 906 or transmits the processing result from a communication unit 908 if necessary via the input-output interface 910 for example, and further causes recording of the processing result on the hard disk 905, or the like.

Note that the input unit 907 includes a keyboard, a mouse, a microphone, and the like. Furthermore, the output unit 906 includes a liquid crystal display (LCD), a speaker, and the like.

Here, in the present description, the processes performed by the computer according to the program do not necessarily have to be performed in time series in the order described as the flowchart. That is, the processing performed by the computer according to the program also includes processing that is executed in parallel or individually (for example, parallel processing or object processing).

Furthermore, the program may be processed by one computer (processor) or may be processed in a distributed manner by a plurality of computers. Moreover, the program may be transferred to a distant computer and executed.

Moreover, in the present description, a system means a set of a plurality of components (devices, modules (parts), and the like), and it does not matter whether or not all components are in the same housing. Therefore, both of a plurality of devices housed in separate housings and connected via a network and a single device in which a plurality of modules is housed in one housing are systems.

Note that the embodiments of the present technology are not limited to the above-described embodiments, and various modifications are possible without departing from the gist of the present technology.

For example, the present technology can take a configuration of cloud computing in which one function is shared by a plurality of devices via a network and processed jointly.

Furthermore, each step described in the above-described flowcharts can be executed by one device, or can be executed in a shared manner by a plurality of devices.

Moreover, in a case where a plurality of processes is included in one step, the plurality of processes included in the one step can be executed in a shared manner by a plurality of devices in addition to being executed by one device.

Furthermore, the effects described in the present description are merely examples and are not limited, and other effects may be provided.

Note that the present technology can have the following configurations.

<1>

A signal processing device including:

an addition signal generation unit that adds input signals of audio of two channels to generate an addition signal;

a center convolution signal generation unit that performs convolution of the addition signal and a head related impulse response (HRIR) in a center direction to generate a center convolution signal;

an input convolution signal generation unit that performs convolution of the input signal and a binaural room impulse response (BRIR) to generate an input convolution signal; and an output signal generation unit that adds the center convolution signal and the input convolution signal to generate an output signal.

<2>

The signal processing device according to <1>, further including a delay unit that delays the input signal to be subjected to the convolution with the BRIR.

<3>

The signal processing device according to <1> or <2>, further including a gain unit that applies a predetermined gain to the addition signal.

<4>

The signal processing device according to any one of <1> to <3>, further including a correction unit that corrects the addition signal.

<5>

The signal processing device according to <4>, in which the correction unit corrects the addition signal so as to compensate for an amplitude characteristic of the HRIR.

<6>

The signal processing device according to any one of <1> to <5>, in which a room impulse response (RIR) included in the BRIR is adjusted so that more indirect sounds for which a L input signal of a left (L) channel out of the input signals is a sound source arrive from a left side than a case where only the input convolution signal is used as the output signal, and more indirect sounds for which a R input signal of a right (R) channel out of the input signals is a sound source arrive from a right side than a case where only the input convolution signal is used as the output signal.

<7>

A signal processing method including:

adding input signals of audio of two channels to generate an addition signal;

performing convolution of the addition signal and a head related impulse response (HRIR) in a center direction to generate a center convolution signal;

performing convolution of the input signal and a binaural room impulse response (BRIR) to generate an input convolution signal; and adding the center convolution signal and the input convolution signal to generate an output signal.

<8>

A program causing a computer to perform a function, the function including:

an addition signal generation unit that adds input signals of audio of two channels to generate an addition signal;

a center convolution signal generation unit that performs convolution of the addition signal and a head related impulse response (HRIR) in a center direction to generate a center convolution signal;

an input convolution signal generation unit that performs convolution of the input signal and a binaural room impulse response (BRIR) to generate an input convolution signal; and an output signal generation unit that adds the center convolution signal and the input convolution signal to generate an output signal.

REFERENCE SIGNS LIST

11, 12 Convolution unit
13 Addition unit
21, 22 Convolution unit
23, 31 Addition unit
32 Convolution unit
33 Multiplication unit
34 Correction unit
41, 42 Delay unit
111, 112, 121, 122 Convolution unit
901 Bus
902 CPU
903 ROM
904 RAM
905 Hard disk
906 Output unit
907 Input unit
908 Communication unit
909 Drive
910 Input-output interface
911 Removable recording medium

The invention claimed is:

1. A signal processing device comprising:

processing circuitry configured to:

add input signals of audio of two channels to generate an addition signal;

correct the addition signal by performing convolution of the addition signal and a correction characteristic, so as to compensate for an amplitude characteristic of a head related impulse response (HRIR);

perform convolution of the corrected addition signal and the HRIR in a center direction to generate a center convolution signal;

perform convolution of each of the input signals and a binaural room impulse response (BRIR) to generate respective input convolution signals; and add the center convolution signal and each of the input convolution signals to generate respective output signals.

2. The signal processing device according to claim 1, wherein the processing circuitry is further configured to delay the input signals to be subjected to the convolution with the BRIR.

3. The signal processing device according to claim 1, wherein the processing circuitry is further configured to apply a predetermined gain to the addition signal.

4. A signal processing device comprising:

processing circuitry configured to:

add input signals of audio of two channels to generate an addition signal;

perform convolution of the addition signal and a head related impulse response (HRIR) in a center direction to generate a center convolution signal;

perform convolution of each of the input signals and a binaural room impulse response (BRIR) to generate respective input convolution signals; and add the center convolution signal and each of the input convolution signals to generate respective output signals, wherein a room impulse response (RIR) included in the BRIR is adjusted so that more indirect sounds for which a L input signal of a left (L) channel out of the input signals is a sound source arrive from a left side than a case where only the input convolution signal is used as the output signal, and more indirect sounds for which a R input signal of a right (R) channel out of the input signals is a sound source arrive from a right side than a case where only the input convolution signal is used as the output signal.

5. A signal processing method comprising:

adding input signals of audio of two channels to generate an addition signal;

correcting the addition signal by performing convolution of the addition signal and a correction characteristic, so as to compensate for an amplitude characteristic of a head related impulse response (HRIR);

performing convolution of the corrected addition signal and the HRIR in a center direction to generate a center convolution signal;

performing convolution of each of the input signals and a binaural room impulse response (BRIR) to generate respective input convolution signals; and adding the center convolution signal and each of the input convolution signals to generate respective output signals.

6. A non-transitory computer readable medium storing instructions that, when executed by processing circuitry, perform a signal processing method comprising:

adding input signals of audio of two channels to generate an addition signal;

correcting the addition signal by performing convolution of the addition signal and a correction characteristic, so as to compensate for an amplitude characteristic of a head related impulse response (HRIR);

performing convolution of the corrected addition signal and the HRIR in a center direction to generate a center convolution signal;

performing convolution of each of the input signals and a binaural room impulse response (BRIR) to generate respective input convolution signals; and adding the center convolution signal and each of the input convolution signals to generate respective output signals.

* * * * *